US009581312B2

(12) United States Patent
Rodgers et al.

(10) Patent No.: US 9,581,312 B2
(45) Date of Patent: Feb. 28, 2017

(54) LED LIGHT FIXTURES HAVING ELONGATED PRISMATIC LENSES

(71) Applicant: CREE, INC., Durham, NC (US)

(72) Inventors: Elizabeth Ann Rodgers, Raleigh, NC (US); Paul Kenneth Pickard, Morrisville, NC (US)

(73) Assignee: CREE, INC., Durham, NC (US)

( * ) Notice: Subject to any disclaimer, the term of this patent is extended or adjusted under 35 U.S.C. 154(b) by 205 days.

(21) Appl. No.: 14/020,757

(22) Filed: Sep. 6, 2013

(65) Prior Publication Data

US 2014/0078728 A1 Mar. 20, 2014

Related U.S. Application Data

(63) Continuation-in-part of application No. 12/961,385, filed on Dec. 6, 2010.

(51) Int. Cl.
*F21S 4/00* (2016.01)
*F21V 5/08* (2006.01)
(Continued)

(52) U.S. Cl.
CPC ..... *F21V 13/04* (2013.01); *F21S 4/20* (2016.01); *F21V 5/008* (2013.01); *F21V 15/013* (2013.01); *F21K 9/61* (2016.08); *F21V 5/04* (2013.01); *F21V 7/005* (2013.01); *F21Y 2101/00* (2013.01); *F21Y 2103/10* (2016.08); *F21Y 2105/10* (2016.08); *F21Y 2115/10* (2016.08)

(58) Field of Classification Search
CPC ..... F21Y 2103/003; F21Y 2105/005; F21S 4/003; F21S 4/008; F21S 8/04; F21V 5/005
See application file for complete search history.

(56) References Cited

U.S. PATENT DOCUMENTS

D85,382 S 10/1931 Guth ..... D26/24
2,356,654 A * 8/1944 Cullman ..... F21V 5/04 200/84 C
(Continued)

FOREIGN PATENT DOCUMENTS

CN 1762061 4/2006
CN 1934389 3/2007
(Continued)

OTHER PUBLICATIONS

Decision of Rejection from Japanese Appl. No. 2013-543207, dated Nov. 25, 2014.
(Continued)

*Primary Examiner* — Ismael Negron
(74) *Attorney, Agent, or Firm* — Koppel, Patrick, Heybl & Philpott

(57) ABSTRACT

A light fixture having at least one light engine comprising a plurality of LEDs arranged on mount surfaces of an elongated mount structure, and an elongated lens mounted over the LEDs so that light emitted from the LEDs interacts with the lens before it escapes the fixture. The elongated lens is shaped to disperse more light in a direction away from an axis normal to the elongated mount structure. The light fixture further comprises a housing and an exit lens attached to the housing to define an interior chamber, the at least one light engine disposed within the interior chamber.

30 Claims, 11 Drawing Sheets

(51) Int. Cl.

| | |
|---|---|
| ***F21V 13/04*** | (2006.01) |
| ***F21V 15/01*** | (2006.01) |
| ***F21V 5/00*** | (2015.01) |
| *F21V 5/04* | (2006.01) |
| *F21V 7/00* | (2006.01) |
| *F21Y 101/00* | (2016.01) |

(56) References Cited

U.S. PATENT DOCUMENTS 3,381,124 A 4/1968 Eisenberg ..... 362/354
4,939,627 A 7/1990 Herst et al. ..... 362/299
5,025,356 A 6/1991 Gawad ..... 362/221
5,526,190 A * 6/1996 Hubble, III ..... F21V 7/0091 347/102
5,823,663 A 10/1998 Bell et al. ..... 362/362
D407,473 S 3/1999 Wimbock ..... D23/328
6,149,283 A 11/2000 Conway et al. ..... 362/236
6,155,699 A 12/2000 Miller et al. ..... 362/293
6,210,025 B1 4/2001 Schmidt et al. ..... 362/362
6,234,643 B1 5/2001 Lichon, Jr. ..... 362/147
6,402,347 B1 6/2002 Maas et al. ..... 362/294
6,443,598 B1 9/2002 Morgan ..... 362/342
6,523,974 B2 2/2003 Engel ..... 362/224
6,578,979 B2 * 6/2003 Truttmann-Battig ..... 362/92
6,598,998 B2 * 7/2003 West ..... G02B 19/0061 257/E33.073
D496,121 S 9/2004 Santoro ..... D26/74
6,871,983 B2 3/2005 Jacob et al. ..... 362/364
6,948,838 B2 * 9/2005 Kunstler ..... F21S 48/215 362/237
6,948,840 B2 9/2005 Grenda et al. ..... 362/555
6,951,415 B2 * 10/2005 Amano ..... F21S 48/215 362/297
7,021,797 B2 4/2006 Minano et al. ..... 362/355
7,049,761 B2 5/2006 Timmermans et al. ..... 315/246
7,063,449 B2 6/2006 Ward ..... 345/102
7,111,969 B2 * 9/2006 Bottesch ..... B60Q 1/0052 362/299
7,175,296 B2 2/2007 Cok ..... 362/147
7,213,940 B1 5/2007 Van de Ven et al. ..... 362/231
7,217,004 B2 * 5/2007 Park ..... F21K 9/00 362/240
7,237,924 B2 7/2007 Martineau et al. ..... 362/231
D556,358 S 11/2007 Santoro ..... D26/74
7,338,182 B1 3/2008 Hastings et al. ..... 362/150
7,341,358 B2 * 3/2008 Hsieh ..... F21V 7/0091 362/97.1
7,510,299 B2 3/2009 Timmermans et al. ..... 362/225
7,520,636 B2 4/2009 Van Der Poel ..... 362/290
D593,246 S 5/2009 Fowler et al. ..... D26/76
7,559,672 B1 * 7/2009 Parkyn et al. ..... 362/244
7,594,736 B1 9/2009 Kassay et al. ..... 362/223
D604,446 S 11/2009 Fowler et al. ..... D26/76
7,618,157 B1 11/2009 Galvez et al. ..... 362/294
7,618,160 B2 11/2009 Chinniah et al. ..... 362/326
D608,932 S 1/2010 Castelli ..... D26/76
7,654,702 B1 2/2010 Ding et al. ..... 362/294
7,661,844 B2 2/2010 Sekiguchi et al. ..... 362/249
D611,183 S 3/2010 Duarte ..... D26/76
7,674,005 B2 3/2010 Chung et al. ..... 362/223
7,686,470 B2 3/2010 Chiang ..... 362/147
7,686,484 B2 3/2010 Heiking et al. ..... 362/375
7,712,918 B2 5/2010 Siemiet et al. ..... 362/241
7,722,220 B2 5/2010 Van de Ven ..... 362/294
7,722,227 B2 5/2010 Zhang et al. ..... 362/364
D617,487 S 6/2010 Fowler et al. ..... D27/76
7,768,192 B2 8/2010 Van de Ven et al. ..... 313/503
7,815,338 B2 10/2010 Siemiet et al. ..... 362/218
7,824,056 B2 11/2010 Madireddi et al. ..... 362/125
7,828,468 B2 11/2010 Mayfield et al. ..... 362/342
D633,247 S 2/2011 Kong et al. ..... D26/88
7,922,354 B2 * 4/2011 Everhart ..... 362/235
7,926,982 B2 * 4/2011 Liu ..... 362/294
7,988,321 B2 8/2011 Wung et al. ..... 362/218
7,988,335 B2 8/2011 Liu et al. ..... 362/294
7,991,257 B1 8/2011 Coleman
7,993,034 B2 8/2011 Wegner ..... 362/296.05
7,997,762 B2 8/2011 Wang et al. ..... 362/249
8,038,314 B2 10/2011 Ladewig
8,038,321 B1 10/2011 Franck et al. ..... 362/249.02
8,070,326 B2 12/2011 Lee ..... 362/307
D653,376 S 1/2012 Kong et al. ..... D26/76
8,092,043 B2 * 1/2012 Lin et al. ..... 362/249.02
8,092,049 B2 1/2012 Kinnune et al. ..... 362/294
8,096,671 B1 1/2012 Cronk ..... 362/147
D657,488 S 4/2012 Lown et al. ..... D26/120
8,162,504 B2 4/2012 Zhang et al. ..... 362/217
8,186,855 B2 5/2012 Wassel et al. ..... 362/373
8,197,086 B2 * 6/2012 Watanabe et al. ..... 362/218
8,201,968 B2 6/2012 Maxik et al.
8,215,799 B2 7/2012 Vanden Eynden et al. .. 362/294
8,246,219 B2 * 8/2012 Teng ..... F21K 9/00 362/217.02
8,256,927 B2 9/2012 Hu ..... 362/218
D670,849 S 11/2012 Lay et al. ..... D26/74
8,317,354 B2 11/2012 Gassner et al. ..... 362/147
D679,848 S 4/2013 Pickard et al. ..... D26/74
8,410,514 B2 4/2013 Kim ..... 257/99
D684,291 S 6/2013 Goelz et al. ..... D26/74
8,480,252 B2 7/2013 Bertram et al. ..... 362/243
8,506,135 B1 8/2013 Oster ..... 362/373
8,556,452 B2 * 10/2013 Simon ..... B29D 11/00278 362/217.07
8,591,058 B2 11/2013 Concepcion ..... 362/231
8,591,071 B2 11/2013 Hochstein ..... 362/294
8,602,601 B2 12/2013 Khazi et al. ..... 362/249.02
8,616,723 B2 * 12/2013 Zhang ..... F21K 9/17 362/218
D698,975 S 2/2014 Blessitt et al. ..... D26/74
8,641,243 B1 2/2014 Rashidi ..... 362/373
D701,988 S 4/2014 Clements ..... D26/74
8,696,154 B2 * 4/2014 Hutchens ..... 362/217.05
8,702,264 B1 4/2014 Rashidi ..... 362/147
8,769,244 B2 7/2014 Kyo ..... 362/218
D714,988 S 10/2014 Park et al. ..... D26/74
D721,198 S 1/2015 Glasbrenner ..... D26/76
9,052,075 B2 6/2015 Demuynck et al.
2003/0063476 A1 4/2003 English et al.
2004/0001344 A1 1/2004 Hecht ..... 365/555
2004/0085779 A1 5/2004 Pond et al. ..... 362/516
2004/0100796 A1 5/2004 Ward
2004/0240230 A1 12/2004 Kitajima
2005/0180135 A1 8/2005 Mayer ..... 362/240
2005/0264716 A1 12/2005 Kim et al.
2005/0281023 A1 12/2005 Gould ..... 362/217.5
2006/0221611 A1 10/2006 Noh ..... 362/247
2006/0262521 A1 11/2006 Piepgras et al. ..... 362/149
2006/0291206 A1 12/2006 Angelini et al. ..... 362/244
2007/0070625 A1 3/2007 Bang ..... 362/241
2007/0109779 A1 5/2007 Sekiguchi et al.
2007/0211457 A1 9/2007 Mayfield et al. ..... 362/223
2007/0253205 A1 11/2007 Welker ..... 362/373
2007/0297181 A1 12/2007 Mayfield et al. ..... 362/342
2008/0019147 A1 1/2008 Erchak ..... 362/607
2008/0037284 A1 2/2008 Rudisill ..... 362/629
2008/0049422 A1 2/2008 Trenchard et al. ..... 362/238
2008/0232093 A1 9/2008 Kim ..... 362/147
2008/0278943 A1 11/2008 Van Der Poel ..... 362/240
2009/0034247 A1 2/2009 Boyer ..... 362/225
2009/0073693 A1 3/2009 Nall ..... 362/249.02
2009/0161356 A1 6/2009 Negley et al. ..... 362/231
2009/0168439 A1 7/2009 Chiang ..... 362/404
2009/0196024 A1 8/2009 Heiking et al. ..... 362/150
2009/0237958 A1 9/2009 Kim
2009/0262543 A1 10/2009 Ho ..... 362/373
2009/0296388 A1 * 12/2009 Wu et al. ..... 362/235
2009/0310354 A1 12/2009 Zampini et al. ..... 362/235
2010/0061108 A1 3/2010 Zhang et al. ..... 362/364
2010/0097794 A1 4/2010 Teng et al. ..... 362/231
2010/0103678 A1 4/2010 Van de Ven et al. ..... 362/294
2010/0110679 A1 5/2010 Teng et al.
2010/0172133 A1 7/2010 Lie ..... 362/235
2010/0177532 A1 7/2010 Simon et al.

(56) References Cited

U.S. PATENT DOCUMENTS

| | | | | |
|---|---|---|---|---|
| 2010/0188609 | A1 | 7/2010 | Matsuki et al. | |
| 2010/0253591 | A1 | 10/2010 | Hwu et al. | 345/1.3 |
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |
| 2010/0271843 | A1 | 10/2010 | Holten et al. | 362/609 |
| 2010/0277905 | A1 | 11/2010 | Janik et al. | 362/235 |
| 2010/0277934 | A1 | 11/2010 | Oquendo, Jr. | 362/433 |
| 2010/0295468 | A1 | 11/2010 | Pederson et al. | 315/294 |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | 362/235 |
| 2011/0090671 | A1 | 4/2011 | Bertram et al. | 362/84 |
| 2011/0141722 | A1 | 6/2011 | Acampora et al. | 362/218 |
| 2011/0141734 | A1* | 6/2011 | Li | F21K 9/17 362/235 |
| 2011/0156584 | A1 | 6/2011 | Kim | 315/32 |
| 2011/0164417 | A1 | 7/2011 | Huang | 362/235 |
| 2011/0175533 | A1 | 7/2011 | Holman | 315/130 |
| 2011/0199005 | A1 | 8/2011 | Bretschneider et al. | |
| 2011/0199769 | A1 | 8/2011 | Bretschneider et al. | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | 362/218 |
| 2011/0267823 | A1 | 11/2011 | Angelini et al. | 362/277 |
| 2011/0305024 | A1* | 12/2011 | Chang | F21K 9/17 362/294 |
| 2012/0033420 | A1* | 2/2012 | Kim et al. | 362/235 |
| 2012/0038289 | A1 | 2/2012 | Jee et al. | 315/291 |
| 2012/0051041 | A1 | 3/2012 | Edmond et al. | 362/231 |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Pickard | |
| 2013/0235568 | A1 | 9/2013 | Green et al. | 362/218 |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101188261 | | 5/2008 |
| CN | 101660715 | | 3/2010 |
| CN | 101776254 | | 7/2010 |
| CN | 101776254 | A | 7/2010 |
| CN | 101790660 | | 7/2010 |
| CN | 101790660 | A | 7/2010 |
| CN | 102072443 | | 5/2011 |
| CN | 202580962 | | 12/2012 |
| DE | 102007030186 | | 1/2009 |
| DE | 202010001832 | | 7/2010 |
| EP | 1298383 | | 4/2003 |
| EP | 1298383 | A2 | 4/2003 |
| EP | 2636945 | A2 | 9/2003 |
| EP | 1357335 | A2 | 10/2003 |
| EP | 1653254 | | 3/2006 |
| EP | 1737051 | | 12/2006 |
| EP | 1847762 | | 10/2007 |
| EP | 1847762 | A2 | 10/2007 |
| EP | 1860467 | | 11/2007 |
| EP | 2287520 | A2 | 2/2011 |
| EP | 2290690 | A2 | 3/2011 |
| GB | 774198 | | 5/1957 |
| JP | 1069809 | | 3/1998 |
| JP | 2002244027 | | 11/2002 |
| JP | 03097327 | | 8/2003 |
| JP | 2004140327 | | 5/2004 |
| JP | 2004345615 | | 12/2004 |
| JP | 2004345615 | A | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| WO | WO 03102467 | | 12/2003 |
| WO | WO 2009030233 | | 3/2009 |
| WO | WO 2009140761 | A1 | 11/2009 |
| WO | WO 2009157999 | | 12/2009 |
| WO | WO 2009157999 | A | 12/2009 |
| WO | WO 2009157999 | A1 | 12/2009 |
| WO | WO 2010024583 | | 3/2010 |
| WO | WO 2010024583 | A2 | 3/2010 |
| WO | WO 2010042216 | | 4/2010 |
| WO | WO 2010042216 | A2 | 4/2010 |
| WO | WO 2011074424 | A1 | 6/2011 |
| WO | 2011098181 | | 8/2011 |
| WO | WO 2011096098 | A1 | 8/2011 |
| WO | WO 2011118991 | A2 | 9/2011 |
| WO | WO 2011140353 | A2 | 11/2011 |

OTHER PUBLICATIONS

Office Action from Mexican Appl. No 100881, dated Nov. 28, 2014.
Grant Notice from European Appl. No. 13701525.1-1757, dated Nov. 24, 2014.
Preliminary Report on Patentability from PCT/US2013/035668, dated Oct. 14, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924, dated Nov. 7, 2014.
Second Office Action and Search Report from Chinese Appl. No 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
International Search Report and Written Opinion from Appl. No. PCT/CN2013/072772, dated Dec. 19, 2013.
International Search Report and Written Opinion from PCT/US2013/049225, dated Oct. 24, 2013.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
Office Action from U.S. Appl. No. 12/961,385, dated Nov. 6, 2013.
Office Action from U.S. Appl. No. 29/387,171, dated May 2, 2012.
Response to OA from U.S. Appl No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/366,970, dated Jun. 19, 2012.
Office Action from U.S. Appl. No. 29/366,970, dated Jun. 24, 2012.
Response to OA from U.S. Appl. No. 29/368,970, filed Nov. 26, 2012.
Preliminary Report and Written Opinion from PCT appl. No. PCT/US2012/047084, dated Feb. 6, 2014.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.

(56) References Cited

OTHER PUBLICATIONS

Office Action from U.S. Appl. No. 13/429,080, dated Apr. 18, 2014.
Office Action from U.S. Appl. No. 12/961,385, dated Mar. 11, 2014.
First Office Action from Chinese Patent Appl. No. 2012800369142, dated Mar. 26, 2015.
Office Action from U.S. Appl. No. 13/464,745, dated Apr. 2, 2015.
Office Action from U.S. Appl. No. 13/442,746, dated Apr. 28, 2015.
Office Action from U.S. Appl. No. 13/368,217, dated May 13, 2015.
Office Action from U.S. Appl. No. 13/828,348, dated May 27, 2015.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
Office Action from U.S. Appl. No. 13/464,745, dated Jul. 16, 2014.
International Preliminary Report on Patentability and Written Opinion from PCT/US2013/021053, dated Aug. 21, 2019.
Communication from European Patent Appl. No. 13701525.1-1757, dated Sep. 26, 2014.
U.S. Appl. No. 12/074,762, filed Mar. 2008, Jacobson, et al.
U.S. Appl. No. 13/442,311, filed Apr. 2012, Lu, et al.
U.S. Appl. No. 13/763,270, filed Feb. 2010, Heeter, et al.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.
International Search Report and Written Opinion from PCT Application No. PCT/US2013/021053, dated Apr. 17, 2013.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
International Search Report and Written Opinion for PCT Application No. PCT/US2011/062396, dated Jul. 13, 2012.
International Search Report and Written Opinion for Patent Application No. PCT/US2011/001517, dated: Feb. 27, 2012.
U.S. Appl. No. 12/418,796, filed Apr. 6, 2009.
U.S. Appl. No. 13/429,080, filed Mar. 23, 2012.
U.S. Appl. No. 13/028,946, filed Feb. 16, 2011.
U.S. Appl. No. 13/306,589, filed Nov. 29, 2011.
US Publication No. US 2007/0115671. date: May 24, 2007 to Roberts et al.
US Publication No. US 2007/0115670. date: May 24, 2007 to Roberts et al.
US Publication No. US 2009/0323334. date: Dec. 31, 2009 to Roberts et al.
US Publication No. US 2009/0225543, date: Mar. 5, 2008 to Roberts et al.
U.S. Appl. No. 12/873,303, filed Aug. 31, 2010 to Edmond. et al.
U.S. Appl. No. 12/961,385, filed Dec. 6, 2010 to Pickard. et al.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
Office Action from Japanese Design Patent Application No. 2011-18570.
Reason for Rejection from Japanese Design Patent Application No. 2011-18571.
Reason for Rejection from Japanese Design Patent Application No. 2011-18572.
Energy Star® Program Requirements for Solid State Lighting Luminaires. Eligibility Criteria—Version 1.1, final: Dec. 19, 2008.
Assist Recommends . . . LED Life for General Lighting: Definition of Life, vol. 1, Issue 1, Feb. 2005.
"IES Approved Method for Measuring Lumen Maintenance of LED light Sources". Sep. 22, 2008. ISBN No. 978-0-87995-227-3. (LM-80).
U.S. Appl. No. 13/649,052, filed Oct. 10, 2012, Lowes, et al.
U.S. Appl. No. 13/649,067, filed Oct. 10, 2012, Lowes, et al.
U.S. Appl. No. 13/207,204, filed Aug. 10, 2011, Athalye, et al.
U.S. Appl. No. 13/365,844.
U.S. Appl. No. 13/662,618, filed Oct. 29, 2012, Athalye, et al.
U.S. Appl. No. 13/462,388, filed May 2, 2012.
U.S. Appl. No. 13/842,150, filed Mar. 15, 2013, Dixon, et al.
U.S. Appl. No. 13/770,389, filed Feb. 19, 2013, Lowes, et al.
U.S. Appl. No. 13/782,820, filed Mar. 1, 2013, Dixon, et al.
First Official Action from European Patent Appl. No. 12 743 003.1-1757, dated Jan. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201160052998.4, dated Jul. 16, 2015.
Office Action from U.S. Appl. No. 13/429,080, dated Sep. 1, 2015.
Office Action from U.S. Appl. No. 19/716,480, dated Sep. 29, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Examination Report from Taiwanese Patent Appl. No. 100131021, dated Jan. 5, 2016.
Examination from European Patent Appl. No. 12743003.1-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535; Jan. 6, 2016.
Office Action from U.S. Appl. No. 13/341,741; Jan. 8, 2016.
Office Action from U.S. Appl. No. 13/873,303; Feb. 2, 2016.
Office Action from U.S. Appl. No. 12/961,385, dated Nov. 27, 2015.
Office Action from U.S. Appl. No. 13/828,348, dated Nov. 4, 2015.
First Office Action from Chinese Patent Appl. No. 2011800588770, dated Sep. 25, 2015.
Office Action from U.S. Appl. No. 13/464,745; Mar. 1, 2016.
Office Action from U.S. Appl. No. 14/716,480; Mar. 3, 2016.
Office Action from U.S. Appl. No. 13/368,217; Mar. 4, 2016.
Office Action from U.S. Appl. No. 13/189,535; Mar. 18, 2016.
Office Action from U.S. Appl. No. 29/466,391; May 10, 2016.
Second Office Action for Application No. 2011800588770; Dated Mar. 29, 2016.
Examination Report from Taiwan Application No. 100131021; Dated Jul. 21, 2016.
Office Action for U.S. Appl. No. 14/716,480; Dated Aug. 26, 2016.
European Summons for Oral Proceedings for Application No. 12743003.1; Dated Sep. 2, 2016.
Office Action for U.S. Appl. No. 13/464,745; Dated Sep. 7, 2016.
Office Action for U.S. Appl. No. 13/828,348; Dated Jun. 2, 2016.
Notice of Reason for Rejection for Japanese Appl. No. 2013-541207; Dated May 24, 2016.

(56) References Cited

OTHER PUBLICATIONS

Notification of Reexamination for Chinese Application No. 2011800529984: Dated Oct. 10, 2016.
Office Action for U.S. Appl. No. 13/828,348 Dated Oct. 17, 2016.
Office Action for European Application No. 11754767.9; Dated Oct. 31, 2016.
Office Action for U.S. Appl. No. 12/873,303 Dated Nov. 25, 2016.
Notice of Allowance for Taiwan Application No. 100131021: Dated Nov. 28, 2016.
Office Action for U.S. Appl. No. 13/368,217; Dated Jan. 3, 2017.

* cited by examiner

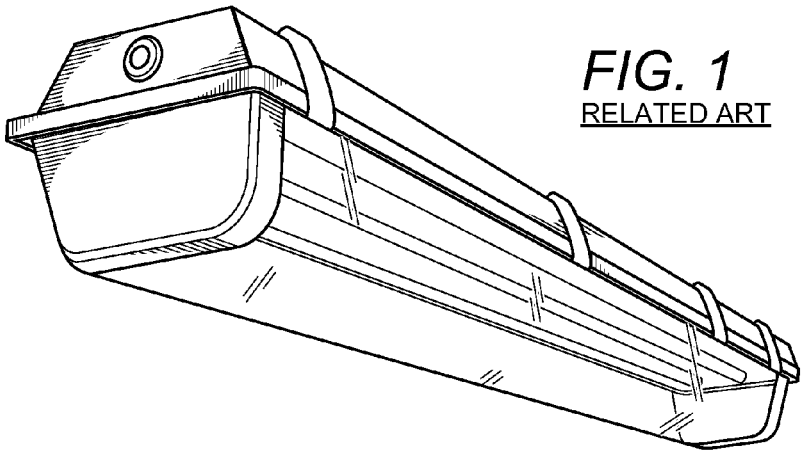
FIG. 1
RELATED ART
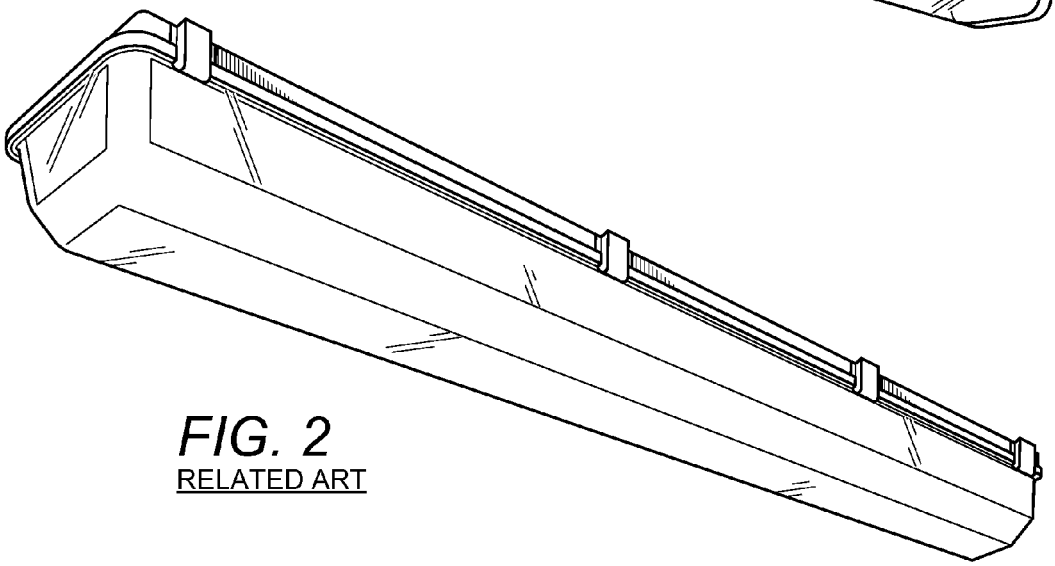
FIG. 2
RELATED ART
FIG. 3
RELATED ART
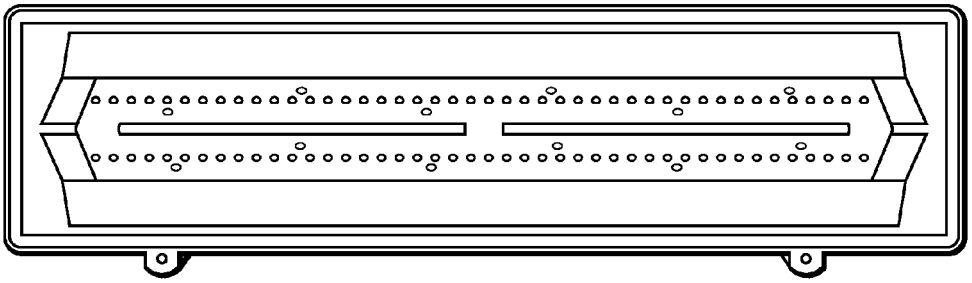

FIG. 6
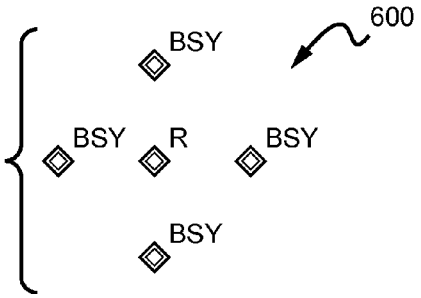
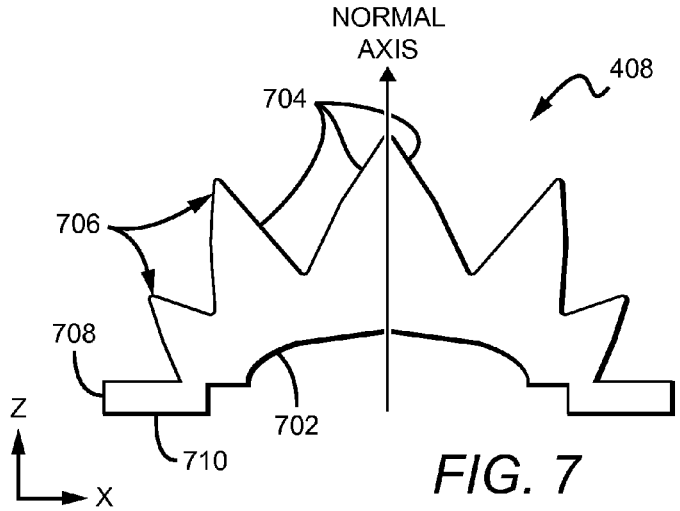
FIG. 7
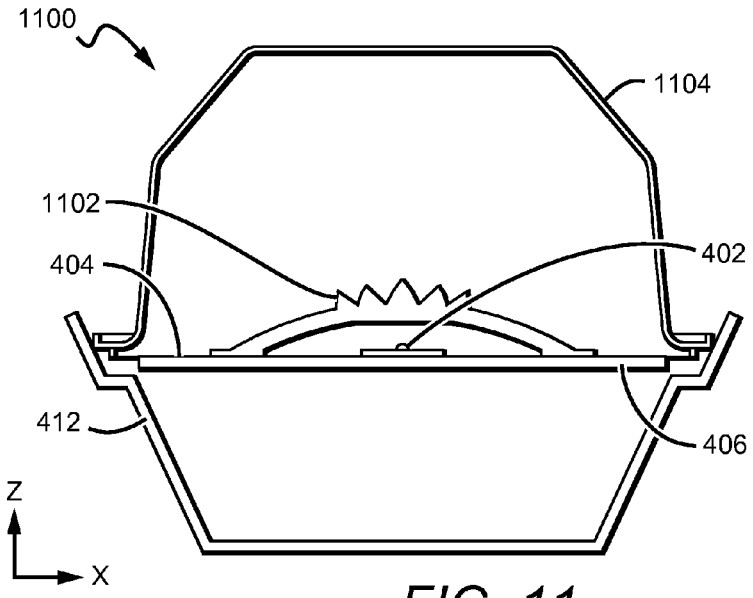
FIG. 11

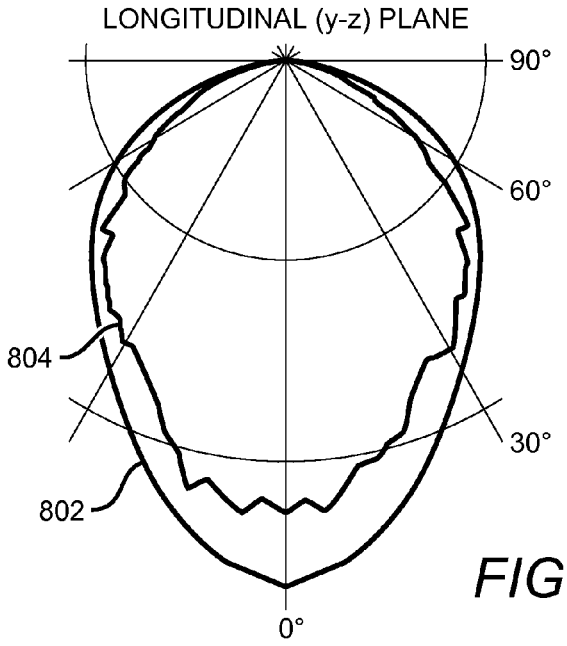
FIG. 8a
FIG. 8b
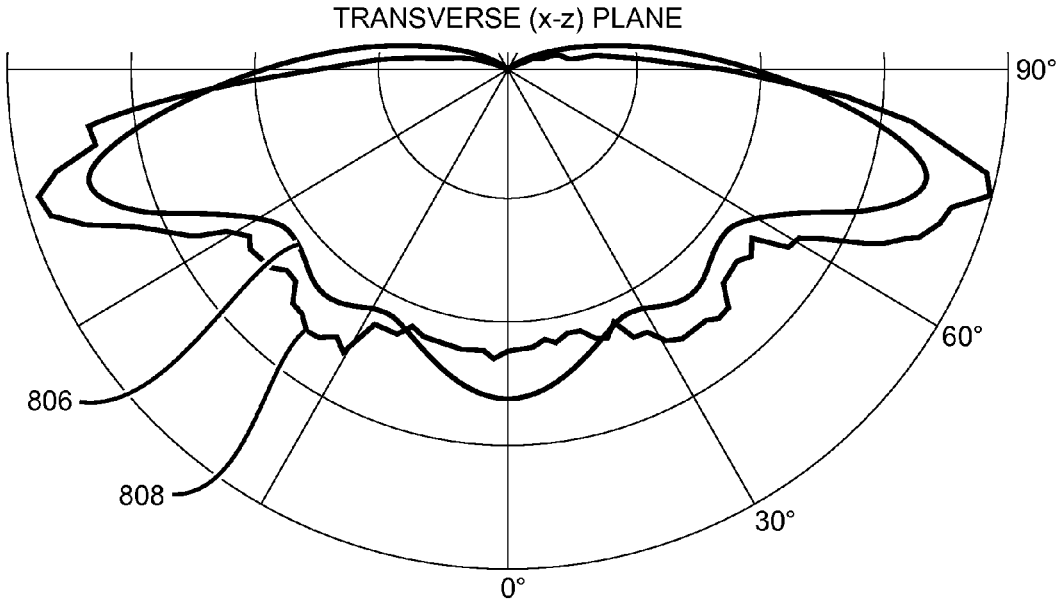

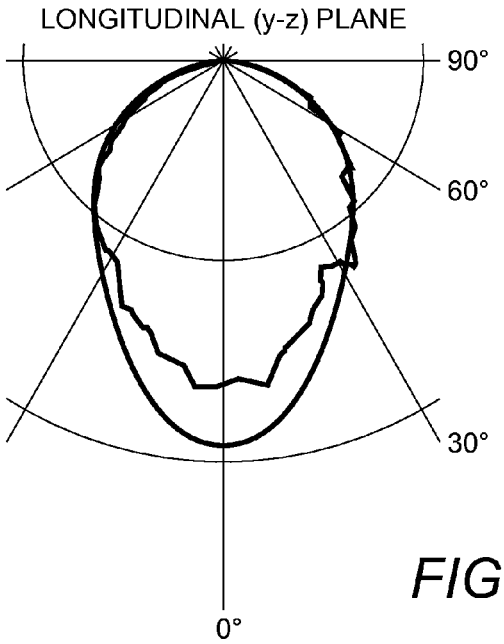
FIG. 9a
FIG. 9b
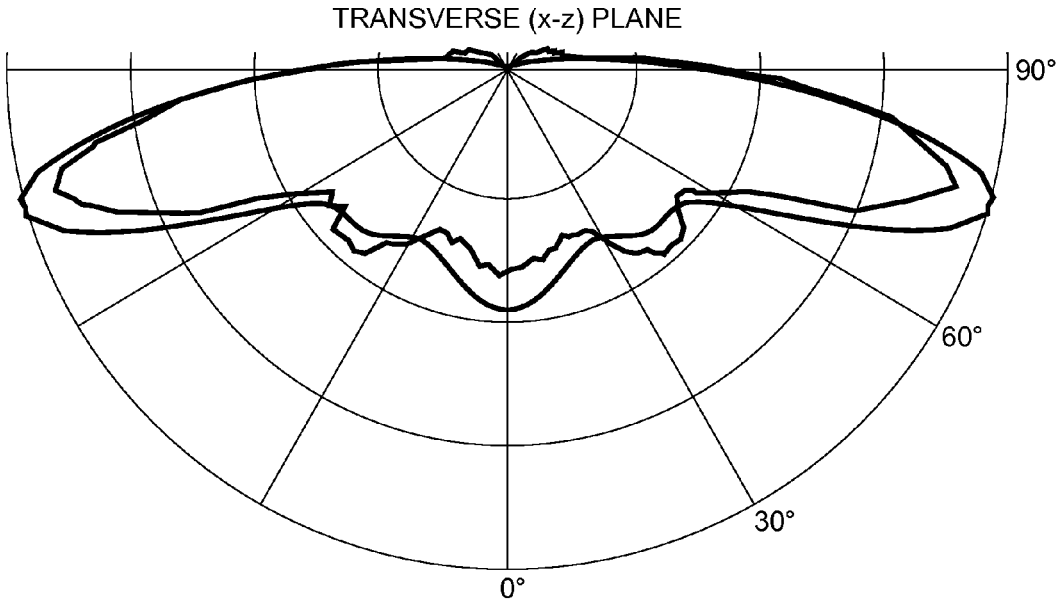

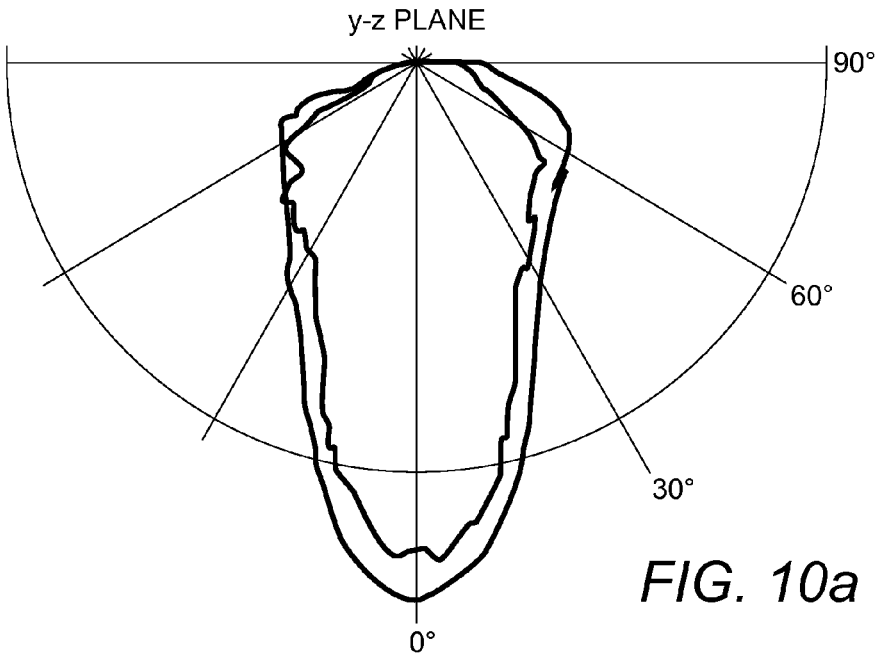
FIG. 10a
FIG. 10b
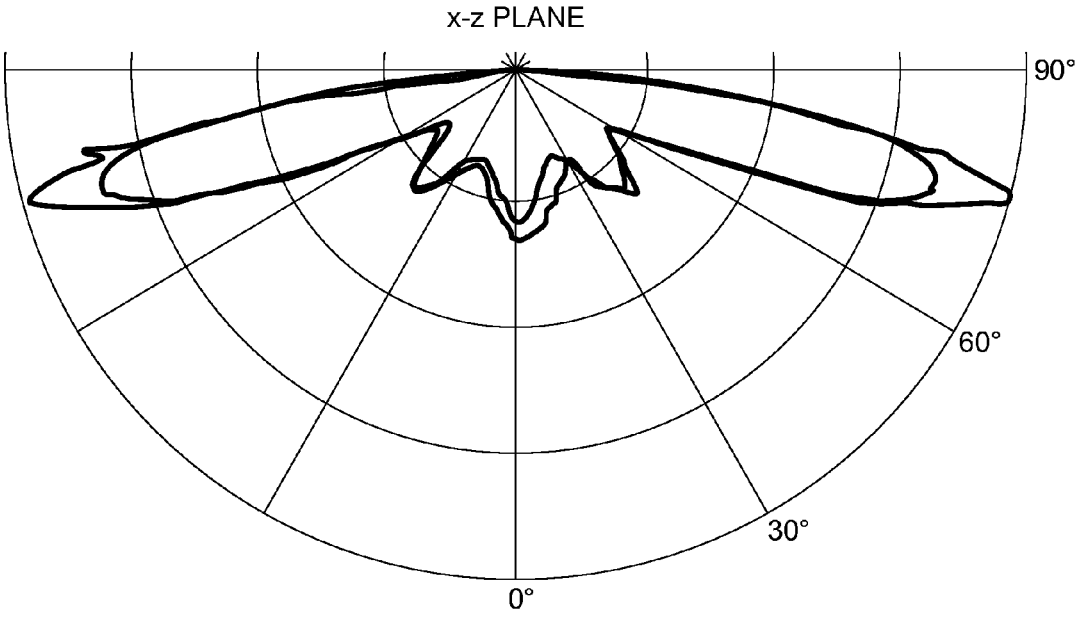

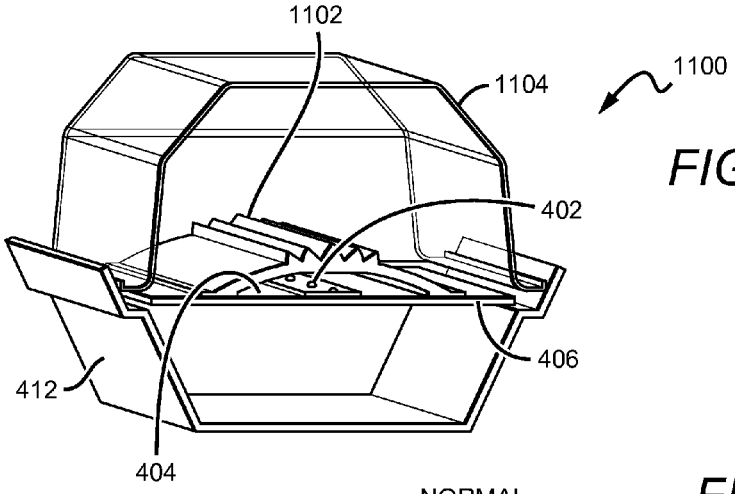
FIG. 12
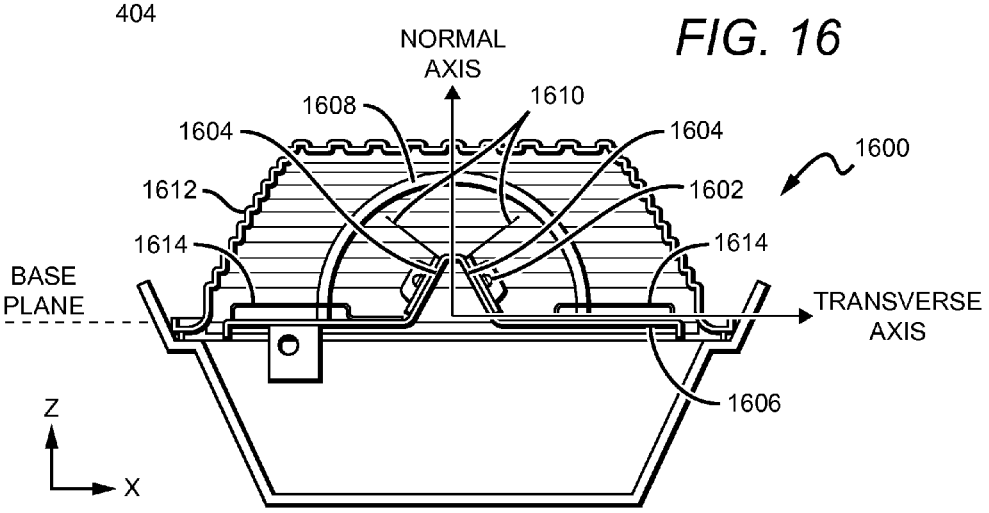
FIG. 16
FIG. 13
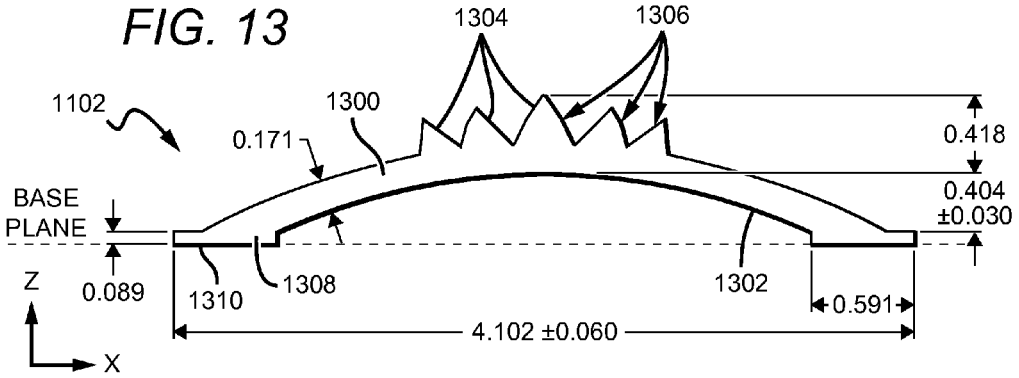

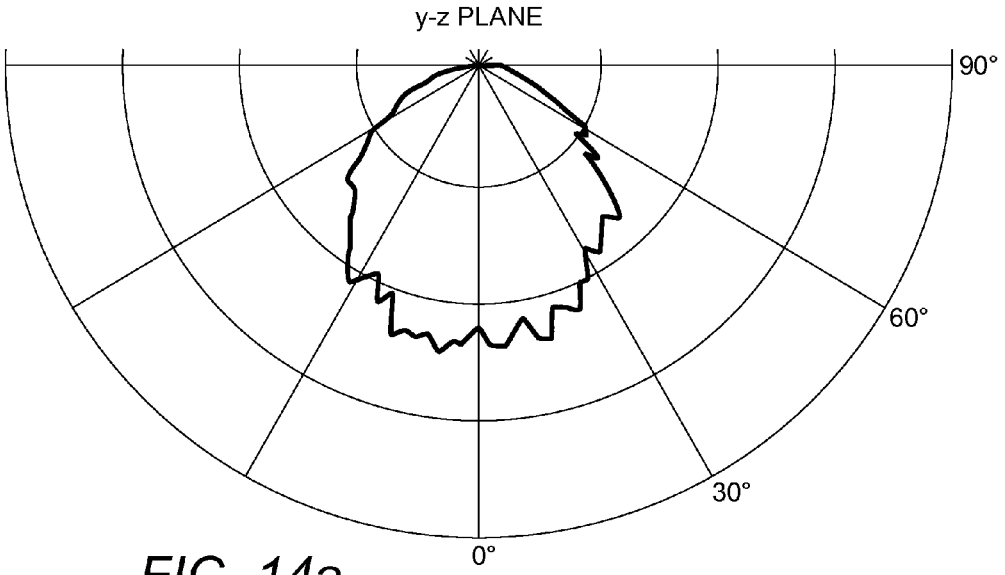
FIG. 14a
FIG. 14b
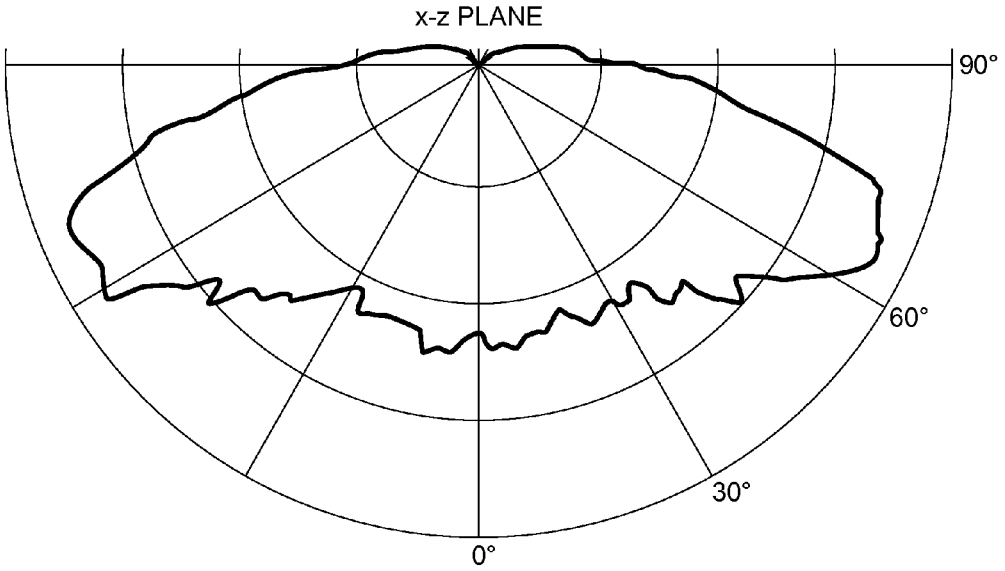

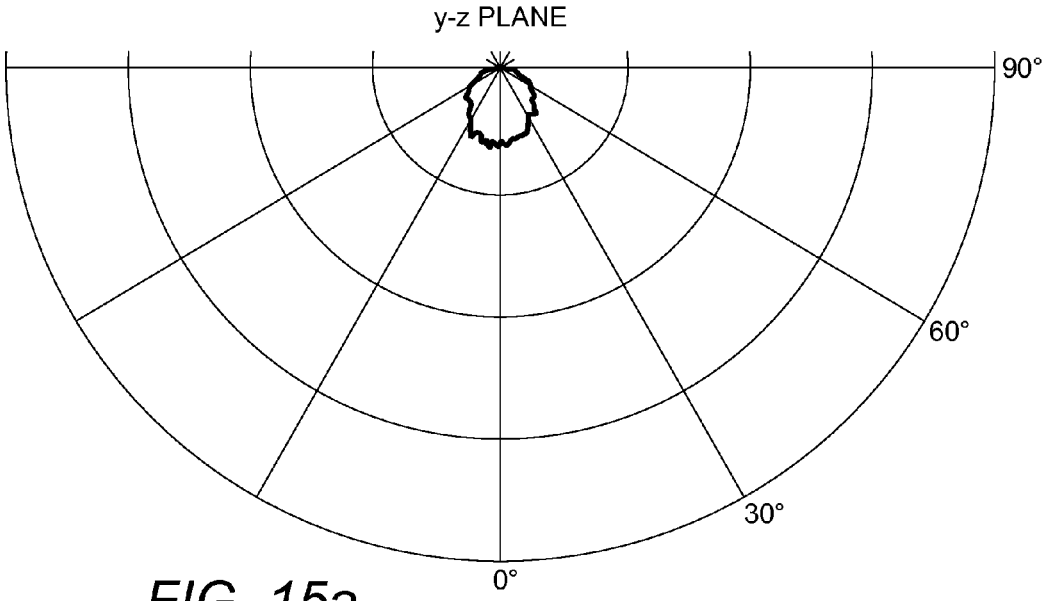
FIG. 15a
FIG. 15b
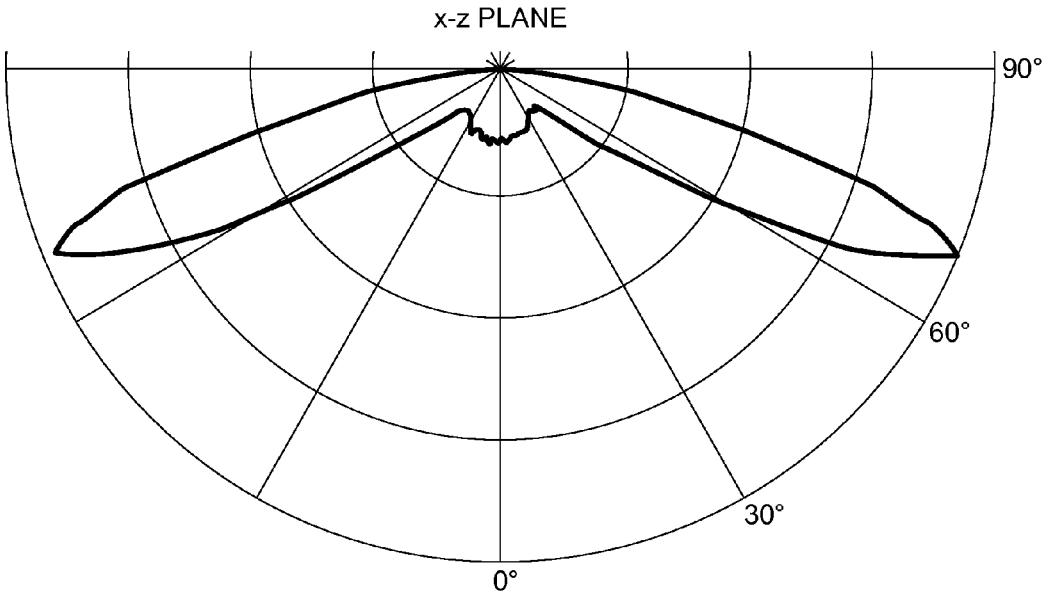

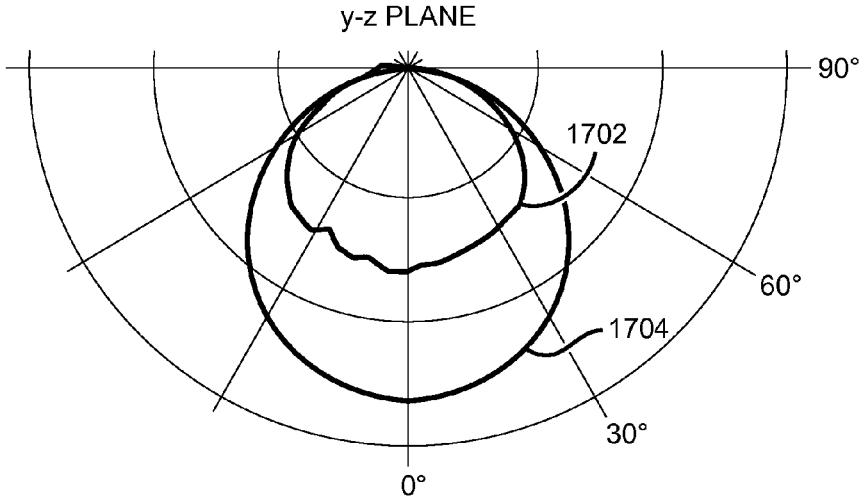
FIG. 17a
FIG. 17b
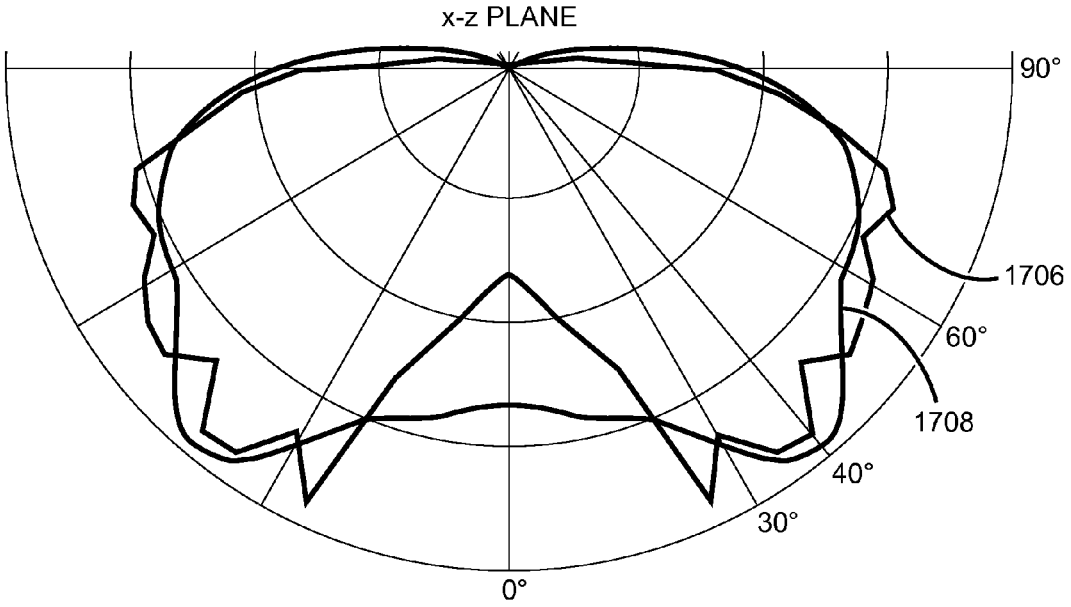

FIG. 18
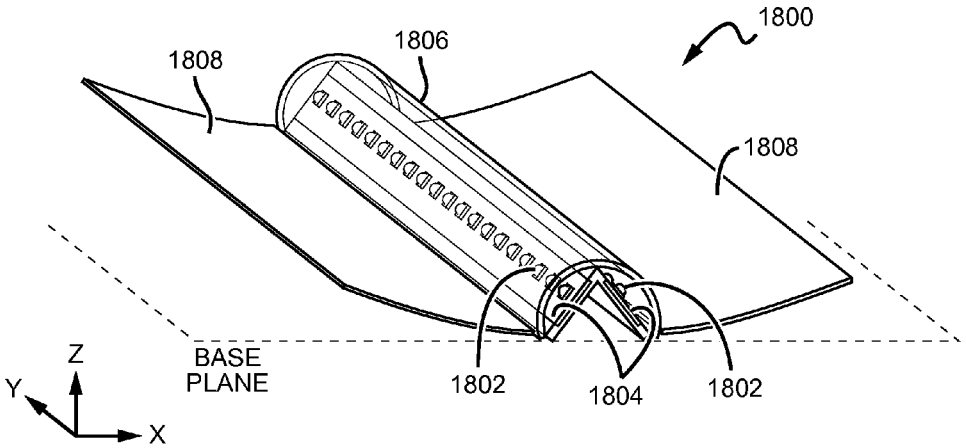
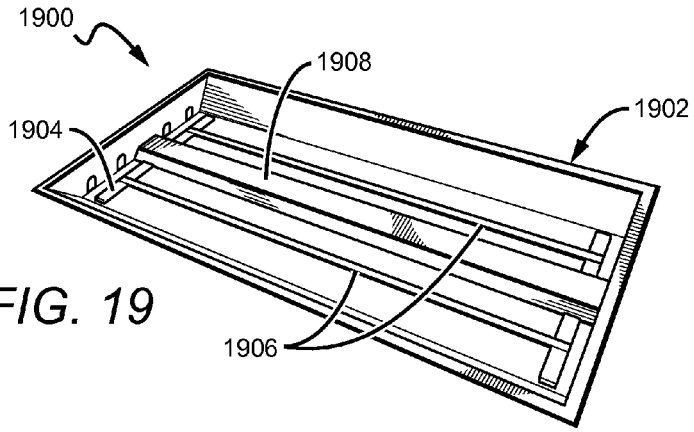
FIG. 19
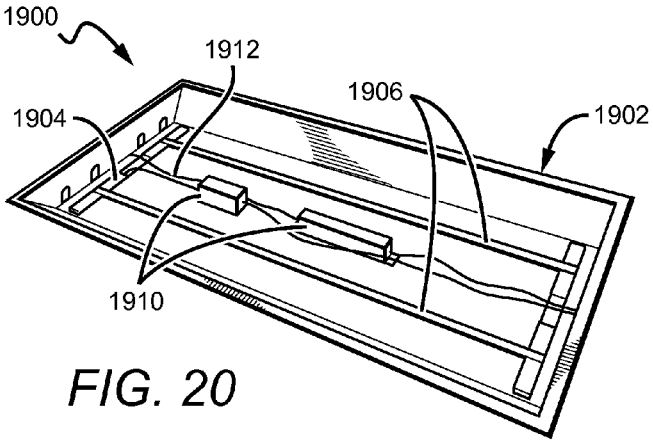
FIG. 20

LED LIGHT FIXTURES HAVING ELONGATED PRISMATIC LENSES

RELATED APPLICATIONS

This application is a continuation-in-part of U.S. patent application Ser. No. 12/961,385 filed on 6 Dec. 2010. The application referred to in this paragraph is hereby incorporated by reference as if set forth fully herein.

BACKGROUND OF THE INVENTION

Field of the Invention

Embodiments of the invention relate to lenses for lighting applications and, more particularly, to linear lenses designed to retrofit systems built for fluorescent tube lights.

Description of the Related Art

Troffer-style fixtures are ubiquitous in commercial office and industrial spaces throughout the world. In many instances these troffers house elongated tubular fluorescent lamps or light bulbs that span the length of the troffer. Troffers may be mounted to or suspended from ceilings, such as being suspended by a "T-grid". Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs as their light source. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

There has been recent interest in upgrading existing troffer style lighting systems with LED sources (or engines) to capitalize on the above advantages. Current options for upgrading include complete fixture replacement such as by the commercially available CR Series Architectural LED Troffer, provided by Cree, Inc. Some features of these troffers are described in U.S. patent application Ser. No. 12/873,303, titled "Troffer-style Fixture", and assigned to Cree, Inc. Performing complete fixture replacement can require penetrating the ceiling plenum by a skilled technician. This can be time consuming and expensive, and in many locations, building codes can require that a licensed electrician perform any work in the plenum space above a ceiling.

Some troffer-style fixtures utilize arrays of LEDs, to achieve a particular light output profile. Arrayed LED designs have become popular due to economies of size and efficiency. Lighting applications may include linear arrays, two-dimensional arrays, and even three-dimensional arrays. U.S. application Ser. No. 12/074,762, commonly assigned to CREE, INC., provides examples of some of these emitter arrays.

Emitter arrays have been used in lighting fixtures. U.S. application Ser. No. 12/873,303, commonly assigned to CREE, INC., discloses, inter alia, solid state emitter arrays used in troffer-style fixtures. Troffer-style fixtures are ubiquitous in commercial office and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al., are examples of typical troffer-style fixtures.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow emitters may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Many current luminaire designs utilize forward-facing LED components with a specular reflector disposed behind the LEDs. One design challenge associated with multi-source luminaries is blending the light from LED sources within the luminaire so that the individual sources are not visible to an observer. Diffusive elements are also used to mix the color spectra from the various sources to achieve a uniform output color profile. To blend the sources and aid in color mixing, diffusive exit windows have been used.

There has been recent interest in upgrading existing troffer-style lighting systems with LED sources (or engines) to capitalize on advantages discussed above. Current options for upgrading include complete fixture replacement such as by the commercially available CR Series Architectural LED Troffer, provided by Cree, Inc. Some features of these troffers are described in U.S. patent application Ser. No. 12/873,303, titled "Troffer-style Fixture", and assigned to Cree, Inc. Performing complete fixture replacement can require penetrating the ceiling plenum by a skilled technician. This can be time consuming and expensive, and in many locations, building codes can require that a licensed electrician perform any work in the plenum space above a ceiling.

Many modern applications require a surface-mount type fixture. Several different surface-mount fixture architectures are offered on the market today, such as the CITADEL™ line of fixture enclosures from SLP Lighting. FIGS. 1 and 2 show perspective views of two such fixtures that are commercially available from SLP Lighting (http://www.slplighting.com/enclosures.html). Several other surface-mount fixtures are also currently available. LED arrays may be mounted within the fixture enclosure and arranged to produce an initial distribution. FIG. 3 shows such an arrangement from one of the CITADEL™ fixtures from SLP Lighting. However, in many cases it may be desirable to provide additional customization to internally shape the beam prior to interaction with the fixture exit lens. Thus, there is a need for light bar and/or light engine units for use in surface-mount fixtures that are capable of producing a desired output profile.

SUMMARY OF THE INVENTION

A light engine according to an embodiment of the present invention comprises the following elements. An elongated mount structure comprises a base plate and at least one mount surface, with a plurality of light emitters on the at least one mount surface. An elongated lens runs in a longitudinal direction proximate to the light emitters such that substantially all light emitted from the light emitters interacts with the lens. The light engine produces a light output with a peak intensity in regions that are off-axis from a central normal axis that is perpendicular to the base plate.

A light fixture according to an embodiment of the present invention comprises the following elements. An exit lens is attached to a fixture housing such that the lens and the fixture housing define an interior chamber. A light engine is disposed within the interior chamber, with the light engine comprising: a plurality of light emitters; an elongated mount structure comprising a base plate and at least one mount surface, with the light emitters on the at least one mount surface; an elongated lens running in a longitudinal direction and proximate to the light emitters such that substantially all light emitted from the light emitters interacts with the lens; and driver electronics connected to power and control the light emitters. The light engine produces a light output with a peak intensity in regions that are off-axis from a central normal axis that is perpendicular to the base plate.

An elongated lens according to an embodiment of the present invention comprises the following elements. An elongated body having a generally arced cross-section is defined by a curved light entry surface on one side and a plurality of light exit surfaces opposite the light entry surface, with the light exit surfaces comprising a plurality of substantially triangular structures protruding from the body away from the light entry surface. The lens has at least one attachment surface for fastening the lens to an external structure.

A light engine according to an embodiment of the present invention comprises the following elements. An elongated mount structure comprises at least one mount surface, with a plurality of light emitters on the at least one mount surface. An elongated lens runs in a longitudinal direction proximate to the light emitters such that substantially all light emitted from the light emitters interacts with the lens. The light engine produces a light output with a peak intensity in regions that are off-axis from a central normal axis that is perpendicular to a base plane.

BRIEF DESCRIPTION OF THE DRAWINGS

FIGS. 1 and 2 show perspective views of two related fixtures that are commercially available from SLP Lighting.

FIG. 3 shows related LED arrays mounted within the fixture enclosure and arranged to produce an initial distribution.

FIG. 6 shows an emitter cluster in which the individual emitters are arranged in a diamond configuration that may be used in embodiments of the present invention.

FIG. 7 is a close-up cross-sectional view of an elongated lens that may be used in embodiments of the present invention.

FIGS. 8*a* and 8*b* are polar graphs of the radiant intensity (W/sr) over the entire range of viewing angles of a light fixture including a ribbed exit lens according to an embodiment of the present invention.

FIGS. 9*a* and 9*b* are polar graphs of the radiant intensity (W/sr) over the entire range of viewing angles of a light fixture including a diffuse smooth exit lens according to an embodiment of the present invention.

FIGS. 10*a* and 10*b* are polar graphs of the radiant intensity (W/sr) over the entire range of viewing angles of a light fixture without an exit lens.

FIG. 11 is a perspective cutaway view of a light fixture according to an embodiment of the present invention.

FIG. 12 is a perspective cutaway view of a fixture according to an embodiment of the present invention from an angle.

FIG. 13 is a close-up cross-sectional view of a lens according to an embodiment of the present invention.

FIGS. 14*a* and 14*b* are polar graphs of the radiant intensity over the entire range of viewing angles of a modeled light fixture that incorporates a lens into the light engine according to an embodiment of the present invention.

FIGS. 15*a* and 15*b* represent the same set of measurements for a light fixture similar to the fixture modeled in FIGS. 14*a* and 14*b* in all respects except that the exit lens has been removed altogether such that the light engine unit is exposed.

FIG. 16 is a perspective cutaway view of a light fixture according to an embodiment of the present invention.

FIGS. 17*a* and 17*b* are polar graphs of the radiant intensity (W/sr) over the entire range of viewing angles of a light fixture 1600 including the ribbed exit lens according to an embodiment of the present invention.

FIG. 18 shows a perspective view of another light bar that may be used in embodiments of the present invention.

FIG. 19 is a perspective view of a troffer-style light fixture according to an embodiment of the present invention.

FIG. 20 is a perspective view of the fixture of FIG. 19 with the raceway cover removed to reveal the components of the power supply underneath.

DETAILED DESCRIPTION OF THE INVENTION

Figure 4:
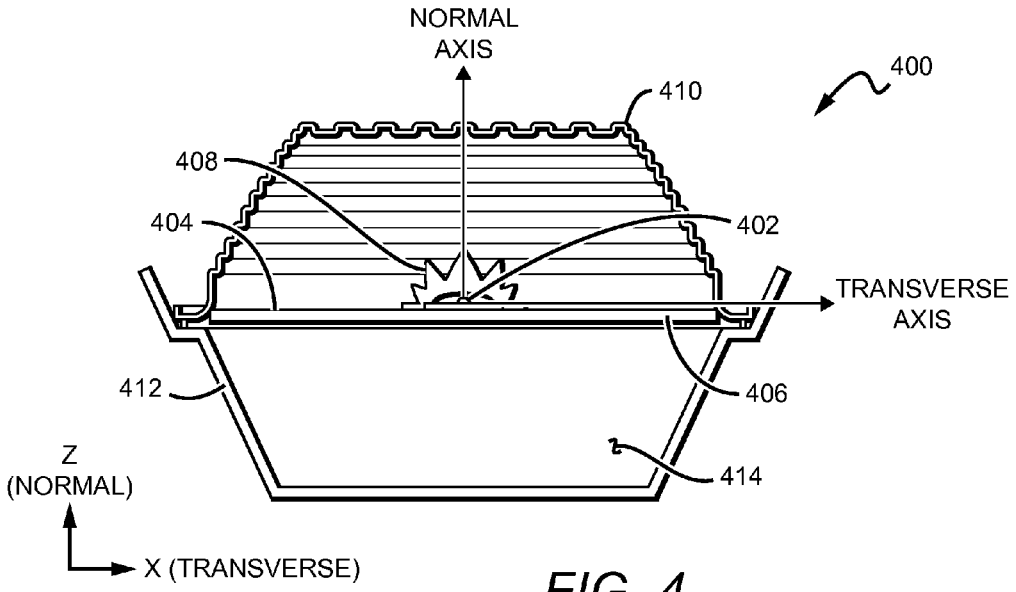
FIG. 4 is a perspective cutaway view of a light fixture according to an embodiment of the present invention.

Embodiments of the present invention provide light fixtures, e.g., surface-mount and troffer-style light fixtures, having retrofit lenses and light engine units therein. In order to mimic the size and appearance of fluorescent bulbs in existing fixtures, LEDs are may be arranged on light bars or mount surfaces with integrated lenses to both diffuse the light and shape the output beam. One or more LEDs can be mounted, sometimes in clusters, along the length of a base of the light engine which can then be inserted into a fixture. An elongated lens is mounted to the base over the LEDs so that light emitted from the LEDs interacts with the lens before it escapes the fixture. These elongated lenses may be extruded from a diffusive material and can be shaped in various ways. For example, the lenses may be shaped to disperse more light to the sides, i.e., in a direction away from a normal axis that is perpendicular to the base.

Embodiments of the present invention may be used in light fixtures and retrofit systems for various different light applications, and are particularly adapted for use with troffer-style and surface-mount fixtures. These systems can provide the same amount of light as traditional light fixtures, for example 1600-4000 lumens and above. The systems can be also used with many different light sources but are particularly well-suited for use with solid state light sources or light engines, such as those utilizing LEDs. The LED light engines can have an elongated form, similar to fluorescent light sources, and can comprise a generally linear array of LEDs. These LED light engines can be referred to herein as a "light source bar" or "light bar." Some embodiments of the present invention comprise a mechanical mounting system for installing an LED light engine within an existing surface-mount or troffer fixture architecture.

In the case of troffer fixtures, by leaving the existing pan in place, embodiments of the present invention can rely on the troffer pan to act as a barrier against the spread of fire and smoke. In many areas, local codes may not allow for the use of plastic components inside the plenum space above the ceiling. This is due to concerns that if a fire occurred in one room, toxic smoke from burning plastics could be carried to other locations which share the air plenum. Maintaining the host fixture troffer pan as a barrier to this spread of toxic smoke can allow for the use of lower cost plastic parts above the ceiling plane in the troffer pan. Without the troffer pan barrier, these plastic parts might otherwise not be allowed in the plenum space.

During the upgrade process, contamination may also be a concern, particularly in a hospital or clean room environment. In upgrade processes where the entire fixture is replaced, the sheet metal pan or housing of an existing troffer lighting system is removed. Removing the host fixture pan can generate dust which must be contained, and the surrounding area must be cleaned prior to resuming normal operations within the environment. Preventing dust is of particular concern in the case of dust containing dangerous materials such as asbestos. In certain environments, construction permits may be required for an upgrade process that requires removal of the troffer pan, which can add additional complications and costs.

Another alternative upgrade option is by a fixture retrofit where a new LED based light engine or light bar can be installed into the sheet metal pan of an existing troffer system or the fixture housing of a surface-mount system. This can provide the advantage of using light bars with design features optimized for an LED-based system including reflectors, lenses, prismatic elements, and power supplies, such as those discussed herein. This approach also allows light engines which are approved for use in other applications to be used in a retrofit application. Some troffer retrofits advantageously eliminate the need to remove the existing troffer pan, with the pan acting as a barrier to the plenum space. Leaving the pan intact during the retrofit process does not disturb wiring connections, insulation, etc., found in the plenum space and may also allow for work to be performed by non-licensed personnel, which can result in a significant cost savings over work performed by licensed electricians.

The present invention is described herein with reference to certain embodiments, but it is understood that the invention can be embodied in many different forms and should not be construed as limited to the embodiments set forth herein. In particular, the present invention is described below with regard to certain troffer and surface-mount type fixtures and retrofit systems that can be used with existing fixtures, but it is understood that elements of the embodiments described can be used to retrofit and/or upgrade different types of lighting systems. The systems can also be used with many different light systems, sources, and engines beyond those described herein, with many being LED-based.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "emitter" can be used to indicate a single light source or more than one light source functioning as a single emitter. For example, the term may be used to describe a single blue LED, or it may be used to describe a red LED and a green LED in proximity emitting as a single source. Additionally, the term "emitter" may indicate a single LED chip or multiple LED chips arranged in an array, for example. Thus, the terms "source" and "emitter" should not be construed as a limitation indicating either a single-element or a multi-element configuration unless clearly stated otherwise. Indeed, in many instances the terms "source" and "emitter" may be used interchangeably. It is also understood that an emitter may be any device that emits light, including but not limited to LEDs, vertical-cavity surface-emitting lasers (VCSELs), and the like.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the present invention are described herein with reference to conversion materials, wavelength conversion materials, phosphors, phosphor layers and related terms. The use of these terms should not be construed as limiting. It is understood that the use of the term phosphor (or phosphor layers) is meant to encompass and be equally applicable to all wavelength conversion materials.

Embodiments of the invention are described herein with reference to cross-sectional and/or cutaway views that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

FIG. 4 is a perspective cutaway view of a light fixture 400 according to an embodiment of the present invention. The light fixture 400 comprises a plurality of light emitters (e.g., LEDs) 402 mounted on a mount surface 404 of an elongated reflective base plate 406 along a longitudinal axis (y-axis; not shown in this view as it runs perpendicular to the cutaway plane). Here, the emitters 402 are mounted in the center of the base plate 406; although, in other embodiments emitters can be mounted at other positions along the transverse axis (x-axis). An elongated lens 408 is mounted over the emitters 402 on the base plate 406 such that light emitted from the emitters 402 impinges on the lens 408 prior to escaping the fixture 400. In this particular embodiment, the lens 408 is shaped to redirect light in a direction away from the normal axis (z-axis).

Many industrial, commercial, and residential applications call for white light sources. The light fixture 400 may comprise one or more emitters (e.g., LEDs) producing the same color of light or different colors of light. In one embodiment, a multicolor source is used to produce white light. Several colored light combinations will yield white light. For example, as discussed in U.S. Pat. Nos. 7,213,940 and 7,768,192, both of which are assigned to Cree, Inc., and both of which are incorporated herein by reference, it is known in the art to combine light from a blue LED with wavelength-converted yellow light to yield white light with correlated color temperature (CCT) in the range between 5000K to 7000K (often designated as "cool white"). Both blue and yellow light can be generated with a blue emitter by surrounding the emitter with phosphors that are optically responsive to the blue light. When excited, the phosphors emit yellow light which then combines with the blue light to make white.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

The light fixture 400 may include the lighting arrangements 500, 520, 540 each of which represent possible LED combinations that result in an output spectrum that can be mixed to generate white light. Each light engine unit can include the electronics and interconnections necessary to power the emitters. In some embodiments the light engine unit comprises a printed circuit board with the emitters mounted and interconnected thereon.

The lighting arrangement 500 includes clusters 502 of discrete LEDs, with each LED within the cluster 502 spaced a distance from the next LED, and each cluster 502 spaced a distance from the next cluster. If the LEDs within a cluster are spaced at too great distance from one another, the colors of the individual sources may become visible, causing unwanted color-striping. In some embodiments, an acceptable range of distances for separating consecutive LEDs within a cluster is not more than approximately 8 mm.

Figure 5A:
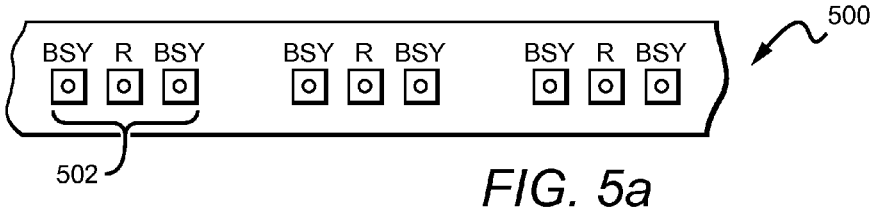
FIGS. 5*a-c* show schematic views of several linear LED arrays that may be used in embodiments of the present invention.
Figure 5B:
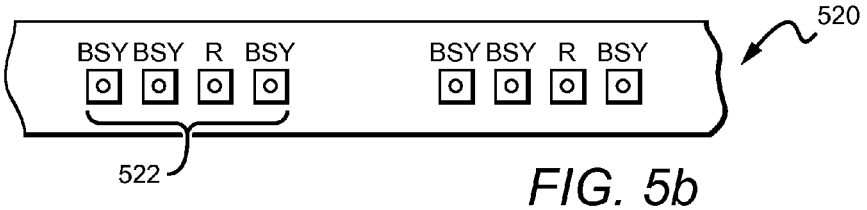
Figure 5C:
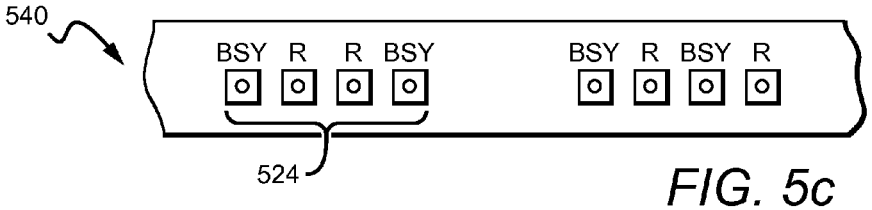

FIGS. 5*a-c* are schematic in nature. Thus, it is understood that the LEDs do not necessarily have to be arranged linearly within each cluster. In some embodiments, each cluster may have LEDs arranged in a diamond shape or a square shape, for example. Many different intra-cluster arrangements are possible.

The scheme shown in FIG. 5*a* uses a series of clusters 502 having two blue-shifted-yellow LEDs ("BSY") and a single red LED ("R"). BSY refers to a color created when blue LED light is wavelength-converted by a yellow phosphor. The resulting output is a yellow-green color that lies off the black body curve. BSY and red light, when properly mixed, combine to yield light having a "warm white" appearance. These and other color combinations are described in detail in the previously incorporated patents to Van de Ven (U.S. Pat. Nos. 7,213,940 and 7,768,192).

The lighting arrangement 520 includes clusters 522 of discrete LEDs. The scheme shown in FIG. 5*b* uses a series of clusters 522 having three BSY LEDs and a single red LED. This scheme will also yield a warm white output when sufficiently mixed.

The lighting arrangement 540 includes clusters 524 of discrete LEDs. The scheme shown in FIG. 5*c* uses a series of clusters 524 having two BSY LEDs and two red LEDs. This scheme will also yield a warm white output when sufficiently mixed.

As previously noted, the emitters do not have to be arranged linearly. In many cases, a non-linear arrangement is required. For example, FIG. 6 shows an emitter cluster 600 in which the individual emitters are arranged in a diamond configuration. In this particular configuration, four BSY emitters surround a single red emitter in the center. It is understood that many layouts including many different color patterns are possible to achieve a particular output profile.

The lighting schemes shown in FIGS. 5*a-c* and FIG. 6 are meant to be exemplary. Thus, it is understood that many different LED combinations can be used in concert with known conversion techniques to generate a desired output light color.

Again with reference to FIG. 4, the base plate 406 may comprise many different materials. For many indoor lighting applications, it is desirable to present a uniform, soft light source without unpleasant glare, color-striping, or hot spots. Thus, the base plate 406 may comprise a diffuse white reflector such as a microcellular polyethylene terephthalate (MCPET) material or a Dupont/WhiteOptics material, for example. Other white diffuse reflective materials can also be used.

Diffuse reflective coatings have the inherent capability to mix light from solid state light sources having different spectra (i.e., different colors). These coatings are particularly well-suited for multi-source designs where two different spectra are mixed to produce a desired output color point. For example, LEDs emitting blue light may be used in combination with LEDs emitting yellow (or blue-shifted yellow) light to yield a white light output. A diffuse reflective coating may help to reduce the need for spatial color-mixing elements that can introduce lossy elements into the system; although, in some embodiments it may be desirable to use a diffuse back reflector in combination with other diffusive elements. In some embodiments, the base may be coated with a phosphor material that converts the wavelength of at least some of the light from the LEDs to achieve a light output of the desired color point.

The base plate 406 can comprise materials other than diffuse reflectors. In other embodiments, the base plate 406 can comprise a specular reflective material or a material that is partially diffuse reflective and partially specular reflective. In some embodiments, it may be desirable to use a specular material in one area and a diffuse material in another area. In yet other embodiments, the base plate 406 may comprise additional reflective structures to redirect light in a particular direction. Many combinations are possible.

In this embodiment, an exit lens 410 is attached to a fixture housing 412 such that they define an interior chamber 414. The housing may be constructed of various materials, including plastics and cold-rolled steel, for example. The exit lens 410 comprises a light transmissive material that allows light from the emitters 402 to exit from the interior chamber 414. In many direct lighting solutions, the light exit surface will be diffusive to improve color mixing and reduce imaging of the sources. Thus, the exit lens 410 of the fixture 400 is shaped to have a ribbed exterior to provide the desired diffusive effect. In other embodiments, the diffusive effect can be achieved within the material itself rather than by external shaping such that the diffusive exit lens can have a smooth exterior finish, giving the lens a frosted or cloudy appearance.

FIG. 7 is a close-up cross-sectional view of the elongated lens 408. In this embodiment, the lens 408 has a body 700 with a generally arced cross-section. One side of the body 700 includes a curved light entry surface 702 with the opposite side of the body including a plurality of light exit surfaces 704. In this particular embodiment, the light exit surfaces 704 are defined by a plurality of substantially triangular structures 706 that protrude from the body 700 away from the light entry surface 702. Here, five triangular structures 706 are used; although it is understood that other embodiments may have more or fewer of these structures. Mounting feet 708 include mount surfaces 710 for fastening the lens to an external surface, such as the base plate 406.

The lens 408 can comprise many different elements and materials. In one embodiment, the lens 408 comprises a diffusive element. Diffusive lenses function in several ways. For example, they can prevent direct visibility of the emitters 402 and provide additional mixing of the outgoing light to achieve a visually pleasing uniform source. However, a diffusive lens can introduce additional optical loss into the system. Thus, in embodiments where the light is sufficiently mixed by other elements external to the light engine (e.g., fixture elements), a diffusive lens may be unnecessary. In some embodiments, scattering particles may be included in the lens 408. Although many different materials may be used to fabricate the lens 408, some suitable materials include poly(methyl methacrylate) (PMMA) and polycarbonates.

Diffusive elements in the lens 408 can be achieved with several different structures. A diffusive film inlay can be applied to a light entry surface or an exit surface. It is also possible to manufacture the lens 408 to include an integral diffusive layer, such as by coextruding the two materials or insert molding the diffuser onto the entry or exit surfaces. A clear lens may include a diffractive or repeated geometric pattern rolled into an extrusion or molded into the surface at the time of manufacture. In another embodiment, the lens material itself may comprise a volumetric diffuser, such as an added colorant or particles having a different index of refraction, for example.

In other embodiments, the lens 408 may be used to optically shape the outgoing beam with the use of microlens structures, for example. Microlens structures are discussed in detail in U.S. patent application Ser. No. 13/442,311 to Lu, et al., which is commonly assigned with the present application to CREE, INC. and incorporated by reference herein.

Several measurements were taken of various light engines and lenses according to various embodiments of the present invention. In addition, several simulations were performed to model the performance of the light engines and lenses and to compare with the measurements that were taken. All simulations referred to herein were created using the LightTools program from Optical Research Associates. LightTools is a software suite well-known in the lighting industry for producing reliable simulations that provide accurate predictions of performance in the real world. Simulations of the various embodiments discussed below include polar graphs showing radiant intensity (W/sr) versus viewing angle (degrees). The light sources used in the simulations mimic the performance of XLamp XP-E LEDs that are commercially available from Cree, Inc.

FIGS. 8*a* and 8*b* are polar graphs of the radiant intensity (W/sr) over the entire range of viewing angles of the light fixture 400 including the ribbed exit lens 410. Two data sets are represented on each graph: a measured data set and a modeled data set. In FIG. 8*a*, the modeled and measured data sets 802, 804 illustrate radiant intensity coming from the light fixture 400 as the viewing angle is swept from 0° to 360° along a longitudinal plane (y-z plane) down the center of the light fixture 400, with 0° representing the head-on view (i.e., directly in front of the light fixture 400 on the lens side) and 180° representing the back side view (i.e., directly behind the light fixture 400 from the housing side). In FIG. 8*b*, the modeled and measured data sets 806, 808 show the radiant intensity coming from the light fixture 400 as the viewing angle is swept from 0° to 360° along a transverse plane (x-z plane) through the center of one of the emitters. All of the polar graphs disclosed herein were generated with the same modeled measurement method.

FIGS. 9*a* and 9*b* represent the same set of measurements for a light fixture similar to the light fixture 400 in all respects except for the exit lens. The interior light engine elements are the same; however, the fixture of FIGS. 9*a* and 9*b* comprises a diffuse smooth exit lens rather than a diffuse ribbed exit lens.

In both fixture embodiments (i.e., ribbed exit lens and smooth exit lens), the light engine units using the lens 408 produce an output distribution in which the peak relative intensity is located in regions that are off-axis from the normal axis, namely in the viewing angle range of 60°-80° on both sides of the fixture, with a relatively uniform intensity distribution in between.

FIGS. 10*a* and 10*b* represent the same set of measurements for a light fixture similar to the fixture 400 in all respects except that the exit lens has been removed altogether such that the light engine unit is exposed. Thus, the data shown represents the output profile within the interior chamber 414 prior to interaction with an exit lens. As shown in FIG. 10*b*, a significant portion of the total light is concentrated in the region between the emission angles of 85° and 65°. This dramatic initial distribution is desirable in some applications to produce the ultimate batwing light output profile after interaction with the exit lens.

FIG. 11 is a perspective cutaway view of a light fixture 1100 according to an embodiment of the present invention. FIG. 12 is a perspective cutaway view of the fixture 1100 from an angle. The fixture 1100 is similar to the fixture 400 in many respects. Thus, similar elements are denoted with the same reference numerals throughout the disclosure. The fixture 1100 comprises a plurality of light emitters (e.g., LEDs) 402 mounted on the elongated reflective base plate 406 along a longitudinal axis (y-axis). In one embodiment, forty (40) LEDs are mounted in a linear array on a 4 ft. base plate. Other embodiments may have a different number of emitters mounted on a differently sized base plate. Here, the emitters 402 are mounted in the center of the base plate 406; although, in other embodiments emitters can be mounted at off-center positions along the transverse axis (x-axis). An elongated lens 1102 is mounted over the emitters 402 on the base plate 406 such that light emitted from the emitters 402 impinges on the lens 1102 prior to escaping the fixture 1100. The lens 1102 is shaped to redirect at least some of the light from the emitters 402 away from the normal axis (z-axis). In this particular embodiment, the exit lens 1104 is diffusive with a smooth external finish. Although it is understood that other kinds of diffuse lenses may also be used, for example, the ribbed exit lens 410 of the fixture 400.

FIG. 13 is a close-up cross-sectional view of the lens 1102. In this embodiment, the lens 1102 has an elongated body 1300 with a generally arced cross-section. One side of the body 1300 includes a curved light entry surface 1302 with the opposite side of the body including a plurality of light exit surfaces 1304. Like the lens 408 shown in FIG. 7, the light exit surfaces 1304 are defined by a plurality of substantially triangular structures 1306 that protrude from the body 1300 away from the light entry surface 1302. Here, five triangular structures 1306 are used; although it is understood that more or fewer of these structures may be used. Mounting feet 1308 include mount surfaces 1310 for fastening the lens to an external surface along the base plane, such as the base plate 406 in the fixture 1100.

The lens 1102 has a substantially more compact profile in the normal direction (z-direction) and is much wider (in the x-direction) than the lens 408. Some exemplary measurements are given in the figure, although it is understood that other sizes may be used to accommodate a particular form factor or produce a desired output profile. Here, the maximum triangular feature size of 0.418 cm is a little less than 2.5 times the size of the lens waist which is 0.171 cm. The ratio between these two measurements should be small so that the lens can easily be manufactured as a monolithic element using an extrusion process. In some embodiments, the ratio of the feature size to the lens waist is less than approximately 3. In other embodiments, the ratio of the feature size to the lens size is less than approximately 2. The ratios mentioned herein are merely exemplary; other thicknesses and feature sizes may also be used, especially if the lens is to be produced by means other than extrusion.

FIGS. 14*a* and 14*b* are polar graphs of the radiant intensity over the entire range of viewing angles of a modeled light fixture that incorporates the lens 1102 into the light engine. FIG. 14*a* shows the radiant intensity over the range of viewing angles in the y-z plane. FIG. 14*b* shows the radiant intensity over the range of viewing angles in the x-z plane. The simulation of this particular fixture includes a ribbed diffuse exit lens similar to the one shown in FIG. 4. As shown in FIG. 14*b* light exiting the fixture has a peak intensity in regions that are off-axis with respect to the z-axis and substantially uniformly distributed over the viewing angles in between.

FIGS. 15*a* and 15*b* represent the same set of measurements for a light fixture similar to the fixture modeled in FIGS. 14*a* and 14*b* in all respects except that the exit lens has been removed altogether such that the light engine unit is exposed. Thus, the data shown represents the output profile within the interior chamber prior to interaction with an exit lens. As shown in FIG. 15*b*, a significant portion of the total light is concentrated in the region between the emission angles of 85° and 70°.

FIG. 16 is a perspective cutaway view of a light fixture 1600 according to an embodiment of the present invention. The light fixture 1600 is similar in many respects to the light fixture 400. One significant difference between the fixtures 400, 1600 is the internal light engine configuration. The light fixture 1600 comprises a plurality of light emitters (e.g., LEDs) 1602 mounted on a mount structure having two mount surfaces 1604 of an elongated reflective base plate 1606 along a longitudinal axis (y-axis). In some light engine unit embodiments, the base plate 1606 may be removed with the mount structure fitting directly within the fixture housing. The mount surfaces 1604 are angled with respect to the normal axis. Here, the emitters 1602 are mounted in a linear array down the center of the mount surfaces 1604; although, in other embodiments emitters can be mounted at other positions on the mount surfaces 1604 or in patterns on the mount surfaces 1604. An elongated lens 1608 is mounted over the emitters 1602 along the base plane on the base plate 1606 such that light emitted from both arrays of emitters 1602 impinges on the lens 1608 prior to escaping the fixture 1600. In this particular embodiment, the lens 1608 has a substantially hemispherical shape to redirect light in a direction away from the normal axis. However, many other lens shapes and sizes are possible.

Two elongated reflector plates 1610 extend away from the mount surfaces 1608 to redirect incident light in a direction away from the normal axis. Thus, at least some light that would have been emitted in the normal direction is initially redirected toward the sides of the fixture 1600 prior to interaction with the exit lens 1612. Additional reflective structures 1614 can be used to tailor the output profile as well. The reflective structures 1614 are disposed on the base plate 1606 and angled slightly to redirect light away from the base plate 1606 toward the exit lens 1612. In other embodiments, the reflective structures may be shaped and/or oriented differently to internally shape the beam.

In this particular embodiment the light engine elements, including the lens 1608, the angled mount surfaces 1604, the reflector plates 1610, and the reflector structures 1614, work in combination to produce the output profile shown in FIGS. 17*a* and 17*b*. It is understood that various elements may be shaped or positioned differently within the light engine unit or removed altogether to produce a different output profile.

FIGS. 17*a* and 17*b* are polar graphs of the radiant intensity (W/sr) over the entire range of viewing angles of the light fixture 1600 including the ribbed exit lens 1612. Two data sets are represented on each graph: a measured data set and a modeled data set. In FIG. 17*a*, the measured and modeled data sets 1702, 1704 illustrate radiant intensity coming from the light fixture 1600 as the viewing angle is swept from 0° to 360° along a longitudinal plane (y-z plane) down the center of the light fixture 1600, with 0° representing the head-on view (i.e., directly in front of the light fixture 1600 on the lens side) and 180° representing the back side view (i.e., directly behind the light fixture 1600 from the housing side). In FIG. 17*b*, the measured and modeled data sets 1706, 1708 show the radiant intensity coming from the light fixture 1600 as the viewing angle is swept from 0° to 360° along a transverse plane (x-z plane). All of the polar graphs disclosed herein were generated with the same modeled measurement method. FIG. 17*b* shows a peak intensity that is off-axis from the normal axis at approximately 40° in both the measured and modeled plots.

FIG. 18 shows a perspective view of another light engine 1800 that may be used in embodiments of the present invention. In this particular embodiment, the LEDs 1802 are mounted to angled mount surfaces 1804 with an elongated lens 1806 that is much closer to the LEDs 1802 than the lens 1608 in the fixture 1600. This particular embodiment includes reflective structures 1808 to redirect at least some of the downlight toward the sides of the light engine 1800. This arrangement provides for a more compact light engine 1800 that still produces the desired off-axis light distribution.

Along with the surface-mount fixture applications previously discussed, lens and light bar elements disclosed herein may also be inserted into preexisting troffer-style fixtures, or these elements may be incorporated into new troffer fixtures that are ready for installation. One exemplary troffer-style fixture is shown in FIGS. 19 and 20. Other examples of these kinds of fixtures are found in U.S. patent application Ser. No. 13/763,270 to Heeter et al., and assigned to Cree, Inc., which is commonly assigned with the present application and fully incorporated by reference herein.

FIG. 19 is a perspective view of a troffer-style light fixture 1900 according to an embodiment of the present invention. A fixture housing 1902, such as a pan structure, surrounds the internal elements and defines the mechanical footprint of the fixture 1900. Mounting brackets 1904 are used to hold light bars 1906 in place within the fixture 1900. The mounting brackets 1904 correctly orient and space the light bars 1906, hold the light bars 1906 in place, and provide a wiring path from the light bars 1906 to the power supply, both hiding the wiring and providing desired spacing or enclosures for electrical ratings, such as high voltage regulatory requirements. A ballast or raceway cover 1908 may be used to protect the power supply and secure the mounting brackets 1904.

FIG. 20 is a perspective view of the fixture 1900 with the raceway cover 1908 removed to reveal the components of the power supply 1910 underneath. Wires 1912 electrically connect the power supply 1910 to the terminals of the light bars 1906.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

We claim:

1. A light engine, comprising:

a plurality of light emitters;

an elongated mount structure comprising a base plate and at least one mount on said base plate, said plurality of light emitters provided on said at least one mount surface; and an elongated lens running in a longitudinal direction and proximate to said plurality of light emitters, wherein said elongated lens surrounds said plurality of light emitters such that substantially all light emitted from said plurality of light emitters interacts with said lens, wherein light emitted from said plurality of light emitters parallel to said base plate and said at least one mount surface directly impinges on said elongated lens;

wherein said light engine produces a light output with a peak intensity in regions that are outside a normal plane extending along the longitudinal center of said light engine and perpendicular to said base plate.

2. The light engine of claim 1, wherein said plurality of light emitters are on at least one light strip, said at least one light strip on said at least one mount surface.

3. The light engine of claim 1, further comprising reflective structures on a base plate, said reflective structures shaped to redirect incident light away from said base plate.

4. The light engine unit of claim 1, further comprising driver electronics connected to power and control said plurality of light emitters.

5. The light engine of claim 1, said mount structure further comprising two mount surfaces each of which are angled with respect to said normal plane.

6. The light engine of claim 5, further comprising reflector plates that extend away from said mount surfaces to redirect incident light in a direction away from said normal plane.

7. The light engine unit of claim 1, said lens comprising a light entry surface proximate to said plurality of light emitters and a plurality of light exit surfaces.

8. The light engine unit of claim 7, wherein said light exit surfaces are defined by a plurality of substantially triangular structures that protrude from said lens away from said light entry surface.

9. The light engine unit of claim 7, wherein said lens is a monolithic structure.

10. The light engine unit of claim 7, said lens further comprising mount feet for fastening to an external structure along the base plane.

11. A light engine, comprising:

a plurality of light emitters;

an elongated mount structure comprising a base plate and at least one mount surface, said plurality of light emitters provided on said at least one mount surface on said base plate; and an elongated lens running in a longitudinal direction and proximate to said plurality of light emitters such that substantially all light emitted from said plurality of light emitters directly impinges on said elongated lens, wherein light emitted from said plurality of light emitters parallel to said base plate and said at least one mount surface directly impinges on said elongated lens;

wherein said light engine produces a light output with a peak intensity in regions that are outside a normal plane extending along the longitudinal center of said base plate and perpendicular to said base plate.

12. The light engine of claim 11, wherein said plurality of light emitters are on at least one light strip, said at least one light strip on said at least one mount surface.

13. The light engine of claim 11, further comprising reflective structures on said base plate, said reflective structures shaped to redirect incident light away from said base plate.

14. The light engine of claim 11, said mount structure further comprising two mount surfaces each of which are angled with respect to said normal plane.

15. The light engine of claim 14, further comprising reflector plates that extend away from said mount surfaces to redirect incident light in a direction away from said normal plane.

16. The light engine unit of claim 11, further comprising driver electronics electrically connected to said plurality of light emitters to power and control said plurality of light emitters.

17. The light engine unit of claim 16, wherein said driver electronics are on said base plate opposite said plurality of light emitters.

18. The light engine unit of claim 11, said lens comprising a light entry surface proximate to said plurality of light emitters and a plurality of light exit surfaces.

19. The light engine unit of claim 18, wherein said light exit surfaces are defined by a plurality of substantially triangular structures that protrude from said lens away from said light entry surface.

20. The light engine unit of claim 18, wherein said lens is a monolithic structure.

21. The light engine unit of claim 18, said lens further comprising mount feet for fastening said lens to said base plate.

22. A light fixture, comprising:

a fixture housing;

an exit lens attached to said fixture housing such that said exit lens and said fixture housing define an interior chamber;

a light engine within said interior chamber, said light engine comprising:

a plurality of light emitters;

an elongated mount structure comprising a base plate and at least one mount surface, said plurality of light emitters provided on said at least one mount surface;

an elongated lens running in a longitudinal direction and proximate to said plurality of light emitters such that substantially all light emitted from said plurality of light emitters interacts with said lens, wherein light emitted from said plurality of light emitters parallel to said base plate and said at least one mount surface directly impinges on said elongated lens; and driver electronics connected to power and control said plurality of light emitters;

wherein said light engine produces a light output with a peak intensity in regions that are outside a normal plane extending along the longitudinal center of said base plate and perpendicular to said base plate.

23. The light fixture of claim 22, wherein said plurality of light emitters are on at least one light strip, said at least one light strip on said at least one mount surface.

24. The light fixture of claim 22, further comprising driver electronics connected to power and control said light emitters.

25. The light fixture of claim 22, wherein said exit lens is diffusive.

26. The light fixture of claim 22, wherein said exit lens is prismatic.

27. The light fixture of claim 22, said elongated lens comprising a light entry surface proximate to said plurality of light emitters and a plurality of light exit surfaces.

28. The light fixture of claim 27, said elongated lens further comprising mount feet for fastening said elongated lens to said base plate.

29. The light fixture of claim 27, wherein said light exit surfaces are defined by a plurality of substantially triangular structures that protrude from said elongated lens away from said light entry surface.

30. The light fixture of claim 29, wherein said elongated lens is a monolithic structure.

* * * * *